United States Patent [19]

Whitman

[11] Patent Number: 4,793,116

[45] Date of Patent: Dec. 27, 1988

[54] BONDING PLATE FOR USE IN RUBBER ROOF INSTALLATION

[76] Inventor: Robert E. Whitman, 1-2143 Sherwood La., Swanton, Ohio 43558

[21] Appl. No.: 204,265

[22] Filed: Jun. 9, 1988

[51] Int. Cl.[4] ..... E04D 5/14

[52] U.S. Cl. ..... 52/173 R; 52/410

[58] Field of Search ..... 52/410, 173 R

[56] References Cited

U.S. PATENT DOCUMENTS

| | | | |
|---|---|---|---|
| 4,688,361 | 8/1987 | Kelly | 52/410 X |
| 4,747,241 | 5/1988 | Whitman | 52/410 X |
| 4,751,802 | 6/1988 | Whitman | 52/410 X |

*Primary Examiner*—David A. Scherbel

*Assistant Examiner*—J. Johnson

*Attorney, Agent, or Firm*—George R. Royer

[57] ABSTRACT

The invention herein is directed to an improved apparatus used for facilitating the process of affixing rectangularly shaped sheets of rubber roofing material to the upper surface of a roof, in which process a plurality of bonding plates are used to bond the rubber roof sheets to the upper roof surface. The invention relates to an improved integrated bonding plate apparatus used as stated, wherein an adhesive material is deployed on both the upper and lower surfaces respectively of such bonding plate apparatus; and wherein such plate has integrally emeshed between the upper and lower surface both a rubber binder plate and a concentrically disposed metallic plate.

1 Claim, 2 Drawing Sheets

BONDING PLATE FOR USE IN RUBBER ROOF INSTALLATION

BACKGROUND OF INVENTION AND DESCRIPTION OF PRIOR ART

The invention herein pertains to an apparatus for helping secure rectangularly shaped sheets of rubber roofing to the upper surface of a roof. Roofing sheets comprised of rubber materials are now used more widely for roof coverings because of the attentdant optimal life and durability. The usual approach is to place over the upper roof surface a grid-like pattern of fastening (bonding) plates, usually square-shaped members, dispersed over the upper roof surface and spaced relative to one another in a regular matrix-like pattern, generally a fixed distance apart.

The rubber roof sheets, in some applications, maybe adhered in a flush manner to the upper surfaces of such fastening plates, using a suitable adhesive. The more common practice is to disperse the fastening plates over the upper surface of the rubber roof sheets to help seal and secure the rubber roof in place over the upper roof deck.

One of the predominant problems with using conventionally structured bonding plates is that such devices do not provide an optimal sealing process in affixing and securing the rubber roof sheets to the roof deck. Frequently water leakage occurs at the point where the bonding plate is fixed to the roof deck, thus detracting substantially from the distinct advantage of using rubber roof coverings.

The subject invention is conceived to overcome such problems in the installation process using rubber roof sheets and the following objects of the subject invention are set forth accordingly.

OBJECTS

In view of the above, it is an object of the subject invention to provide an improved apparatus for affixing rubber roofing sheets to the upper surface of a roof;

Yet another object of the subject invention is to provide an improved bonding device in installing rubber roof sheets for covering roof structures;

Still another object of the subject invention is to provide an improved device for adhering and affixing rubber roof sheets to the upper surface of a roof;

Still another object of the subject invention is to provide versatile bonding plates used in roofing application;

Other and further objects of the subject invention will become apparent from a reading of the following description taken in conjunction with the claims.

DESCRIPTION OF GENERAL EMBODIMENT

The invention herein is directed to an improved apparatus used for facilitating the process of affixing rectangularly shaped sheets of rubber roofing material to the upper surface of a roof, in which processes a plurality of bonding plates are used to bond the rubber roof sheets to the upper roof surface. The invention relates to an improved integrated bonding plate apparatus used as stated, wherein an adhesive material is deployed on both the upper and lower surfaces respectively of such bonding plate apparatus; and wherein such plate has integrally emeshed between its upper and lower surface both a rubber binder plate and a concentrically disposed metallic plate, the latter being centrally disposed.

DESCRIPTION OF PREFERRED EMBODIMENT

The subject invention centers on a physical apparatus for process of affixing a plurality of rubber roof sheets to the upper surface of a roof of any type of building structure. However, the preferred embodiment of the subject invention is most applicable to roof structures wherein the roof is horizontal, although it is not to be so limited. Moreover, description and application of the preferred embodiment is not to be considered as limiting the scope of the subject invention.

Figures 3, 4, 5:
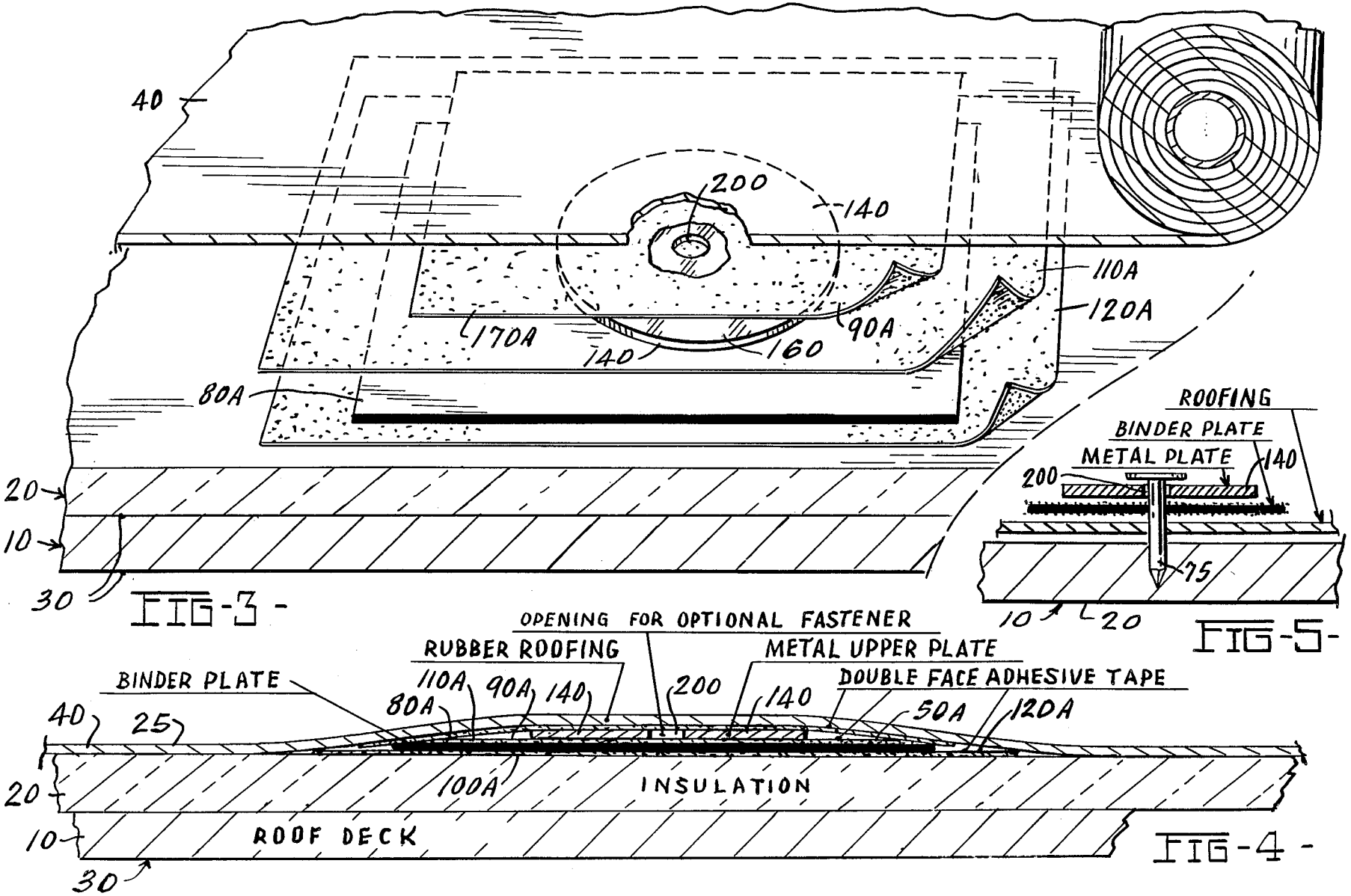
FIG. 3 is a top perspective view of the subject device demonstrating how it is applied.
FIG. 4 is a side elevational view of the subject device demonstrating how it is affixed to fasten rubber roof sheets.
FIG. 5 is a side elevational view of a portion of the subject invention, indicating how it is affixed to a roof deck.

Turning now to the drawings, the subject invention involves an apparatus to aid in the affixing of rubber roof sheets to a roof such as roof deck 10 shown in FIGS. 3 and 4. In this respect, the roof deck 10 is a horizontal, flat structure having perimeter edges not shown. Such roof deck 10 is considered conventional in this regard, however, the subject invention can apply to a roof of any external configuration, whether rectangular, flat or other structural shape.

As a preliminary consideration in the process of affixing rubber roof sheets to roof deck 10, the first step in the process is to affix a flat layer of insulation 20 over the upper surface 25 of the roof deck, as shown in FIGS. 3 and 4. In some structural arrangements, the insulation layer is affixed underneath the undersurface 30 of the roof deck, although this latter arrangement is not shown in the drawings. The next step is to place over the insulation layer a plurality of rectangular shaped rubber roof sheets, such as sheets 40, shown in figures 3 and 4. As seen, the roofing sheets 40 are affixed in a grid-like pattern so that all sheets cover the entire roofing surface in a flush manner. Next, a plurality of bonding plates 50A, 50B . . . incorporating features of the subject invention are affixed either over or under the adjoining rubber roofsheets 40, once laid generally and preferably in a series of evely-spaced rows and columns, in regular grid-like pattern, as seen from an upper elevational view. These bonding plates 50A, 50B . . . function to secure the rubber roof sheets 40 to the upper surface of the roof deck 10 or that may underlie the rubber roof sheet.

As stated previously, it is not critical to the subject invention that the bonding plate 50A be affixed in a regular pattern, however. Particularly, in the preferred embodiment shown, the bonding plate 50A is spaced a horizontal distance from one another by several feet. These distances are considered optional and are not critical to the subject invention, however, but are described and illustrated to demonstate the matrix-like grid over which the bonding plates are dispersed.

Figure 2:
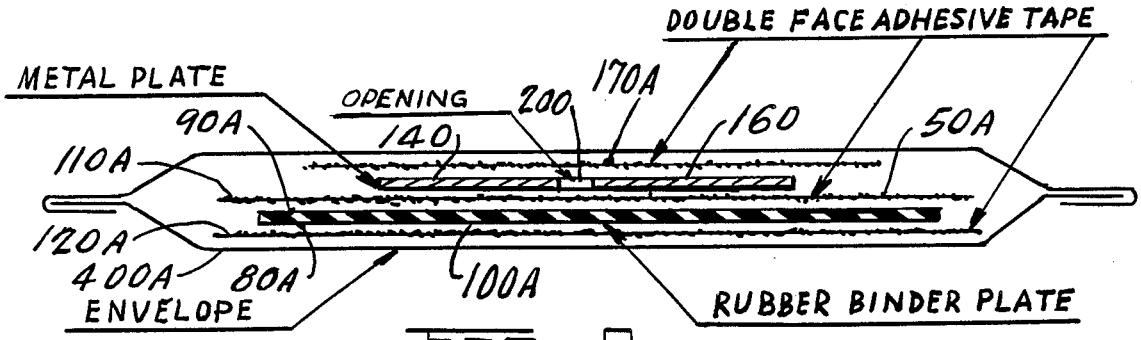
FIG. 2 is a side elevational view of the subject device.

As stated, the bonding plates 50A, 50B . . . incorporating the subject invention can be deployed by placing them over both the insulation layer 30 and the adjoining rubber roof sheets 40A, 40B . . . once such rubber roof sheets are emplaced, as seen in FIG. 2. By being so placed over the top of the rubber roof sheets 40A, 40B . . . the bonding plate covers only a portion of the rubber roof sheet, as seen in FIG. 2. Once emplaced over the top of the rubber roof sheet 40, the bonding plates 50A,50B . . . are affixed to the roof 10 by a nail 75 passing through the rubber roof sheet, as shown in FIG. 5. In an alternate arrangement, as shown in FIGS. 3 and 4, the bonding plates are placed over the insulation layer 40, and the rubber roof sheets are placed on top of the bonding plates, after they are affixed. The subject invention is equally applicable to either such described arrangement.

As shown, bonding plate 50A is constructed and comprised in part of a rectangular binder base plate member 80A preferably of square or rectangular shape and formed preferably of a pliable rubber material or other flexible material. Such base binder plate member 80A has an upper surface 90A and a lower surface 100A. This central base plate member 80A functions as the main central and support element for the bonding plate 40A. Adhered or otherwise fastened to both of the upper surface 90A and the lower surface 100A of the base binder plate 80A are doublefaced adhesive layers 110A and 120A respectively.

Affixed to the upper surface of the adhesive layer 110A is a metallic washer-like member 140 of generally circular configuration. This latter circular configuration is not essential to the subject invention, however. The circular washer member 140A has an upper surface 150A and a lower surface 160A. The lower surface of the washer plate member 140A is adhered in a flush manner against and to the upper surface of adhesive layers 110A, as shown.

Adhered conformingly and in a flush manner to the upper surface 160A of the washer plate member 140A is yet another double adhesive layer 170A, as shown in FIG. 2. Moreover, as shown in the drawings, the washer plate member 140 has a centrally disposed opening 200, which functions as the opening into which a longitudinally extending fastening device is inserted, as well as through the remaining layers parts, above described, as the bonding plate 50A, such as nail 300A, as shown in FIG. 5, to be driven into the roof deck structure 10 so as to affix the bonding plate 50A to the roof structure.

Figure 1:
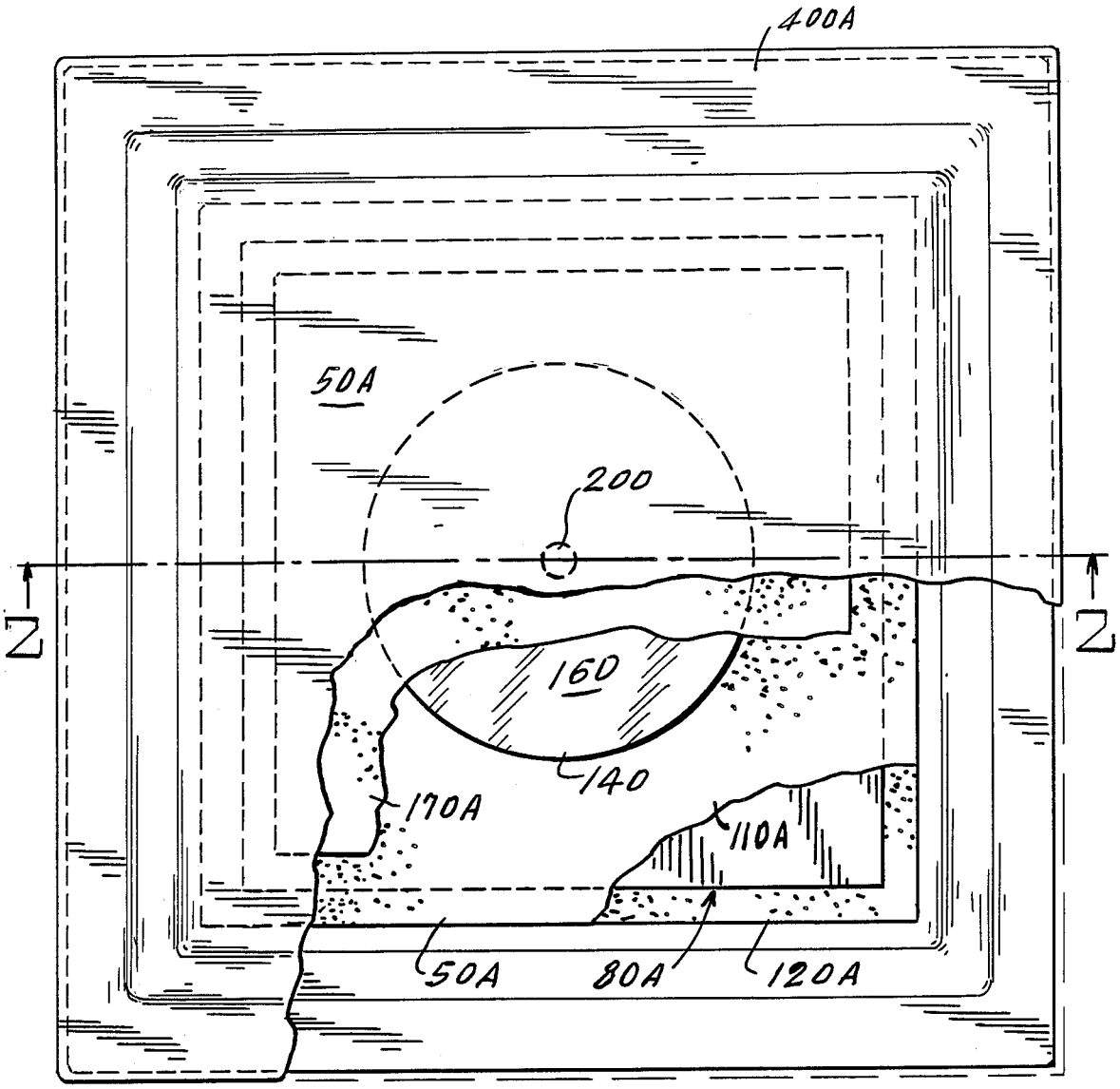
FIG. 1 is a top planar view of the bonding plate device utilizing the invention herein.

Enveloping the entire bonding plate apparatus thusly described is a removable envelope 400A, as shown, which envelope 400A is of a neutral material that envelopes both the upper and lower surface areas of bonding plate 50A, and which can be removed when the plate is to be installed. The resultant bonding plate member 50A 40A shown as being a rectangular member, is viewed from a top elevational view as shown in FIG. 1, and is essentially a multilayered sandwich-like member in which the five resultant layers of functional materials described above, are pressed together in a flush manner, layer over layer, as depicted in FIG. 2 and described above. As described, the central binder support member 80A is the main support member, with the circular washer plate 140A adding further a rigid support in the middle of the multiple layers. In the one embodiment shown, and discussed, such metallic plate 140A has a circular opening 200 in the middle thereof to receive a longitudinally extending fastening member 400 which projects in a direction perpendicular to the layered members, vertically downwardly through the roof structure so as to fasten the bonding plate 50A and the adjoining roofing sheet 40 to the roof deck 10. As shown in FIG. 2 the central base binding plate 80A is shown as being slightly larger in area as seen from a top elevational view, than the area of metallic plate 140A. It must be indicated that this area ratio between the metallic plate 140 and the central binding plate 80A is preferable, but non-critical in the constructional implementations of the subject invention.

As can be surmised, the remaining bonding plates 50B, 50C . . . are all idential in structure to bonding plate 50A, and the number of such bonding plates that are used will be directly dependent on the area of roof space to be covered.

After the bonding plate 50A is affixed to the upper surface of the roof 10 and the covering envelope 400 is removed, the upper adhesive layer 70A is exposed upwardly, and the rubber roofing sheets can be laid flush over the upper surfaces of the bonding plates 50A so as to adhere the upper surfaces of the adhesive layer 170A. This functions to adhere the rubber roof sheet to the bonding plate. Alternately, as stated, the bonding plates 50A, 50B are affixed in a flush manner to the upper surface of roof sheets 40A, 40B . . .

I claim:

1. A multiple-layered bonding plate device for facilitating the process of affixing rubber roofing sheetings to the upper surface of a roof comprising said bonding plate comprising:

(a) a base central binder plate member having an upper surface and a lower surface;

(b) first double-faced adhesive layered material affixed to the lower surface of said base central binding plate, said faced adhesive layered material having an upper surface and a lower surface;

(c) second double-faced adhesive layered material affixed to the upper surface of said base binder plate member, said double-faced adhesive layered material having an upper surface and a lower surface;

(d) metallic plate member having an upper surface and a lower surface with the lower surface of said metallic plate member being adhered to the upper surface of said second double-faced adhesive layered material;

(e) third double-faced adhesive layered material having an upper surface and a lower surface; said third double-faced adhesive layered material being affixed to the upper surface of said metallic plate member, and;

(f) removable envelope covering the entire bonding plate member.

* * * * *